US010510313B2

(12) United States Patent
Xie

(10) Patent No.: US 10,510,313 B2
(45) Date of Patent: Dec. 17, 2019

(54) DRIVING CIRCUIT OUTPUTTING A CHAMFERED WAVE SCANNING SIGNAL, DRIVING METHOD AND DISPLAY APPARATUS

(71) Applicant: BOE Technology Group Co., Ltd., Beijing (CN)

(72) Inventor: Hongjun Xie, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 107 days.

(21) Appl. No.: 15/221,258

(22) Filed: Jul. 27, 2016

(65) Prior Publication Data

US 2017/0213514 A1 Jul. 27, 2017

(30) Foreign Application Priority Data

Jan. 26, 2016 (CN) ..... 2016 1 0051667

(51) Int. Cl.

| | |
|---|---|
| ***G09G 3/30*** | (2006.01) |
| ***G09G 3/36*** | (2006.01) |
| ***G09G 3/3266*** | (2016.01) |
| ***G09G 3/3225*** | (2016.01) |
| *G09G 5/18* | (2006.01) |

(52) U.S. Cl.

CPC ..... *G09G 3/3677* (2013.01); *G09G 3/3225* (2013.01); *G09G 3/3266* (2013.01); *G09G 5/18* (2013.01); *G09G 2310/066* (2013.01); *G09G 2310/08* (2013.01); *G09G 2320/0219* (2013.01); *G09G 2320/0233* (2013.01)

(58) Field of Classification Search

CPC ..... G09G 3/3266

See application file for complete search history.

(56) References Cited

U.S. PATENT DOCUMENTS

2011/0157123 A1* 6/2011 Cho ..... G09G 3/3266 345/211

2011/0169796 A1 7/2011 Guo et al.

(Continued)

FOREIGN PATENT DOCUMENTS

CN 102129845 A 7/2011

CN 203118407 U 8/2013

(Continued)

OTHER PUBLICATIONS

Aug. 2, 2017—(CN) First Office Action Appn 201610051667.3 with English Tran.

*Primary Examiner* — Sanghyuk Park

(74) *Attorney, Agent, or Firm* — Banner & Witcoff, Ltd.

(57) ABSTRACT

A driving circuit, a driving method and a display apparatus are provided. The driving circuit comprises: a gate driving module; a timing control module; and a chamfered wave generating circuit, an input terminal thereof being connected with the timing control module, an output terminal thereof being connected with an input terminal of the gate driving module, and being configured to discharge a power supply voltage provided by a power supply of the display apparatus under an effect of a timing control signal output by the gate driving module, so that the gate driving module outputs a chamfered wave scanning signal. The display quality of the display apparatus can be improved.

11 Claims, 6 Drawing Sheets

(56) References Cited

U.S. PATENT DOCUMENTS

| | | | | |
|---|---|---|---|---|
| 2012/0038610 | A1 | 2/2012 | Li et al. | |
| 2012/0262497 | A1* | 10/2012 | Chang | G09G 3/3674 345/690 |
| 2014/0340381 | A1 | 11/2014 | Kim et al. | |
| 2015/0116305 | A1 | 4/2015 | Chung et al. | |
| 2017/0076657 | A1 | 3/2017 | Lu et al. | |

FOREIGN PATENT DOCUMENTS

| | | | |
|---|---|---|---|
| CN | 105070243 | A | 11/2015 |
| JP | 4704438 | B2 | 6/2011 |
| KR | 101483627 | B1 | 1/2015 |

* cited by examiner

DRIVING CIRCUIT OUTPUTTING A CHAMFERED WAVE SCANNING SIGNAL, DRIVING METHOD AND DISPLAY APPARATUS

This application claims priority to and the benefit of Chinese Patent Application No. 201610051667.3 filed on Jan. 26, 2016, which application is incorporated herein in its entirety.

TECHNICAL FIELD

This disclosure relates to a driving circuit, a driving method and a display apparatus.

BACKGROUND

As a display apparatus, a TFT-LCD (Thin Film Transistor Liquid Crystal Display) mainly comprises a liquid crystal panel configured to display pictures, a driving circuit configured to driving the liquid crystal circuit and a power supply circuit configured to supply a power supply for operating to the driving circuit.

There is a driving circuit comprising a gate driving module configured to provide a pulse signal to the liquid crystal panel, a source driving module configured to provide a data signal to the liquid crystal panel and a timing control module configured to output a timing control signal to control timings of the gate driving module and the source driving module.

Usually, there is a parasitic capacitance between a gate and source of a Thin Film Transistor (TFT). Therefore, when a level of a scanning pulse signal applied by the gate driving module to the gate of the TFT changes, for example from a high level to a low level, a potential at the gate suffers a great falling. At this time, due to the parasitic capacitance, a potential at the source will also suffer a great falling, leading to a feed through, causing the pictures dark. Therefore, a display quality of such display apparatus is poor.

SUMMARY

In order to solve the problem that the display quality of a display apparatus is poor, this disclosure provides a driving circuit, a driving method and a display apparatus.

In a first aspect, a driving circuit is provided, comprising a gate driving module and a timing control module. The driving circuit further comprises a chamfered wave generating circuit, wherein, an input terminal of the chamfered wave generating circuit is connected with an output terminal of the timing control module, and an output terminal of the chamfered wave generating circuit is connected with an input terminal of the gate driving module. The chamfered wave generating circuit is configured to discharge, under an effect of the timing control signal output by the timing control module, a power supply voltage provided by a power supply circuit of the display apparatus so as to generate a target chamfered wave signal, and output the target chamfered wave signal to the gate driving module so that the gate driving module outputs a chamfered wave scanning signal.

Optionally, the chamfered wave generating circuit comprises a first control unit, a second control unit and a discharging unit connected in turn, wherein a connection point of the first control unit and the first control unit is an output terminal of the chamfered wave generating circuit.

In a case where the timing control signal is a first level signal, the second control unit turns off under an effect of the timing control signal, and the first control unit turns on under an effect of the timing control signal and outputs the power supply voltage via the output terminal of the chamfered wave generating circuit.

In a case where the timing control signal is a second level signal, the first control unit turns off under an effect of the timing control signal, and the second control unit turns on under an effect of the timing control signal and discharges the output terminal of the chamfered wave generating circuit via the discharging unit so as to lower the power supply voltage to a predetermined value to obtain the target chamfered wave signal, and then outputs the target chamfered wave signal to the gate driving module via the output terminal of the chamfered wave generating circuit.

Optionally, the first control unit comprises a first transistor.

A first pole of the first transistor is connected with the output terminal of the timing control module, a second pole the first transistor is connected with an output terminal of the power supply circuit, and a third pole of the first transistor is connected with the second control unit.

Optionally, the second control unit comprises a second transistor.

A first pole of the second transistor is connected with the output of the timing control module, a second pole of the second transistor is connected with the third pole of the first transistor, and a third pole of the second transistor is connected with the discharging unit.

Optionally, the discharging unit comprises a discharging resistor and a negative power supply.

One end of the discharging resistor is connected with the third pole of the second transistor, and the other end of the discharging resistor is connected with the negative power supply.

Optionally, the first transistor is an N-type transistor, the second transistor is a P-type transistor, the first level signal is a high level signal and the second level signal is a low level signal.

In a second aspect, a driving method is provided, comprising:

discharging, by a chamfered wave generating circuit, under an effect of a timing control signal output by a timing control module, a power supply voltage provided by a power supply circuit of a display apparatus, so as to generate a target chamfered wave signal; and outputting, by the chamfered wave generating circuit, the target chamfered wave signal to a gate driving module, so that the gate driving module outputs a chamfered wave scanning signal.

Optionally, the chamfered wave generating circuit comprises a first control unit, a second control unit and a discharging unit connected in turn, wherein a connection point of the first control unit and the first control unit is an output terminal of the chamfered wave generating circuit.

The discharging, by a chamfered wave generating circuit, under an effect of a timing control signal output by a timing control module, a power supply voltage provided by a power supply circuit of a display apparatus, so as to generate a target chamfered wave signal, comprises:

in a case where the timing control signal is a first level signal, outputting, by the first control unit, the power supply voltage via the output terminal of the chamfered wave generating circuit; and in case where the timing control signal is a second level signal, discharging, by the second control unit, the output terminal of the chamfered wave generating circuit to a predetermined voltage via the discharging unit.

Optionally, the outputting, by the chamfered wave generating circuit, the target chamfered wave signal to a gate driving module, comprises: outputting the target chamfered wave signal to the gate driving module via the output terminal of the chamfered wave generating circuit.

Optionally, the first control unit comprises a first transistor.

A first pole of the first transistor is connected with the output terminal of the timing control module, a second pole the first transistor is connected with an output terminal of the power supply circuit, and a third pole of the first transistor is connected with the second control unit.

Optionally, the second control unit comprises a second transistor.

A first pole of the second transistor is connected with the output of the timing control module, a second pole of the second transistor is connected with the third pole of the first transistor, and a third pole of the second transistor is connected with the discharging unit.

Optionally, the discharging unit comprises a discharging resistor and a negative power supply.

One end of the discharging resistor is connected with the third pole of the second transistor, and the other end of the discharging resistor is connected with the negative power supply.

Optionally, the first transistor is an N-type transistor, the second transistor is a P-type transistor, the first level signal is a high level signal and the second level signal is a low level signal.

In a third aspect, a display apparatus is provided, comprising the driving circuit according to the first aspect.

This disclosure provides a driving circuit, a driving method and a display apparatus. The chamfered wave generating circuit of the driving circuit can discharge the power supply voltage provided by the power supply circuit of the display apparatus under an effect of the timing control signal output by the timing control module, to generate a periodical target chamfered wave signal with a big sawtooth depth, so that the gate driving module outputs the chamfered wave scanning signal. Thus, the potential of the gate is prevented from a great falling when the level of the target chamfered wave signal changes, the feed through is weakened, the luminance of the displayed pictures and in turn the display quality of the display apparatus is improved.

It should be understood that the above general description and the details hereafter are only illustrative and explanatory, instead of limiting the disclosure.

DETAILED DESCRIPTION OF THE EMBODIMENTS

The embodiments of the disclosure will be described below in detail combining with the figures so that the purpose, the technical solution and the advantages of the disclosure becomes more apparent.

Figure 1:
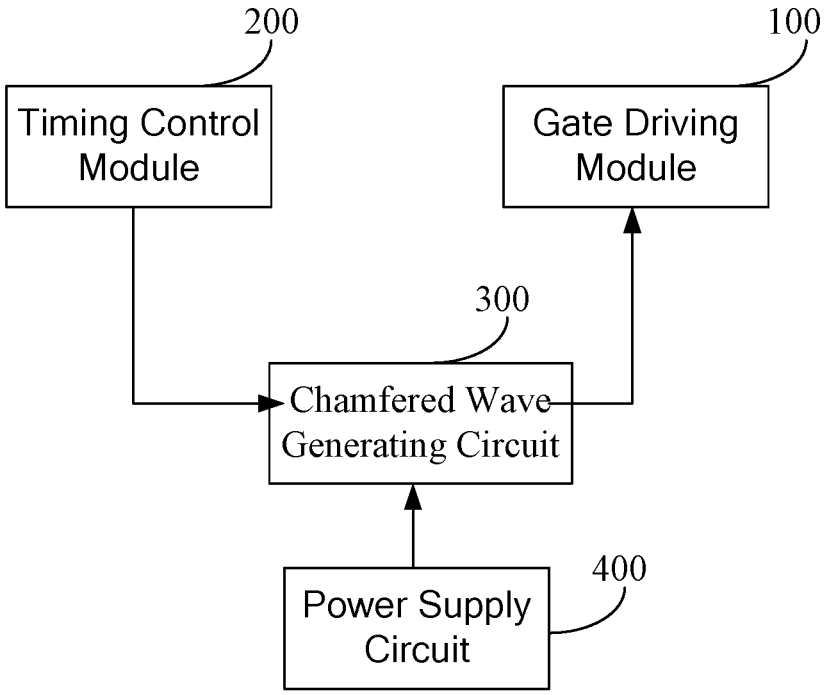
FIG. 1 is a schematic diagram of a structure of a driving circuit provided by an embodiment of the disclosure.

An embodiment of the disclosure provides a driving circuit. As shown in FIG. 1, the driving circuit comprises a gate driving module 100, a timing control module 200 and a chamfered wave generating circuit 300.

An input terminal of the chamfered wave generating circuit 300 is connected with an output terminal of the timing control module 200, and an output terminal of the chamfered wave generating circuit 300 is connected with an input terminal of the gate driving module 100.

The chamfered wave generating circuit discharge a power supply voltage provided by a power supply circuit 400 of the display apparatus under an effect of a timing control signal output by the timing control module 200, generates a target chamfered wave signal and output the same to the gate driving module 100 so that the gate driving module 100 output a chamfered wave scanning signal.

The chamfered wave generating circuit of the driving circuit provided by the embodiment of the disclosure can discharge the power supply voltage provided by the power supply circuit of the display apparatus under an effect of a timing control signal output by the timing control module, generate a periodical target chamfered wave signal with a big sawtooth depth, and output the target chamfered wave signal to the gate driving module, so that the gate driving module outputs a chamfered wave scanning signal. Thus, a potential at the gate can be prevented from falling greatly when a level of the target chamfered wave signal changes, the feed through can be weakened and the luminance of the displayed pictures and in turn the displaying quality of the display apparatus can be improved.

Figure 2:
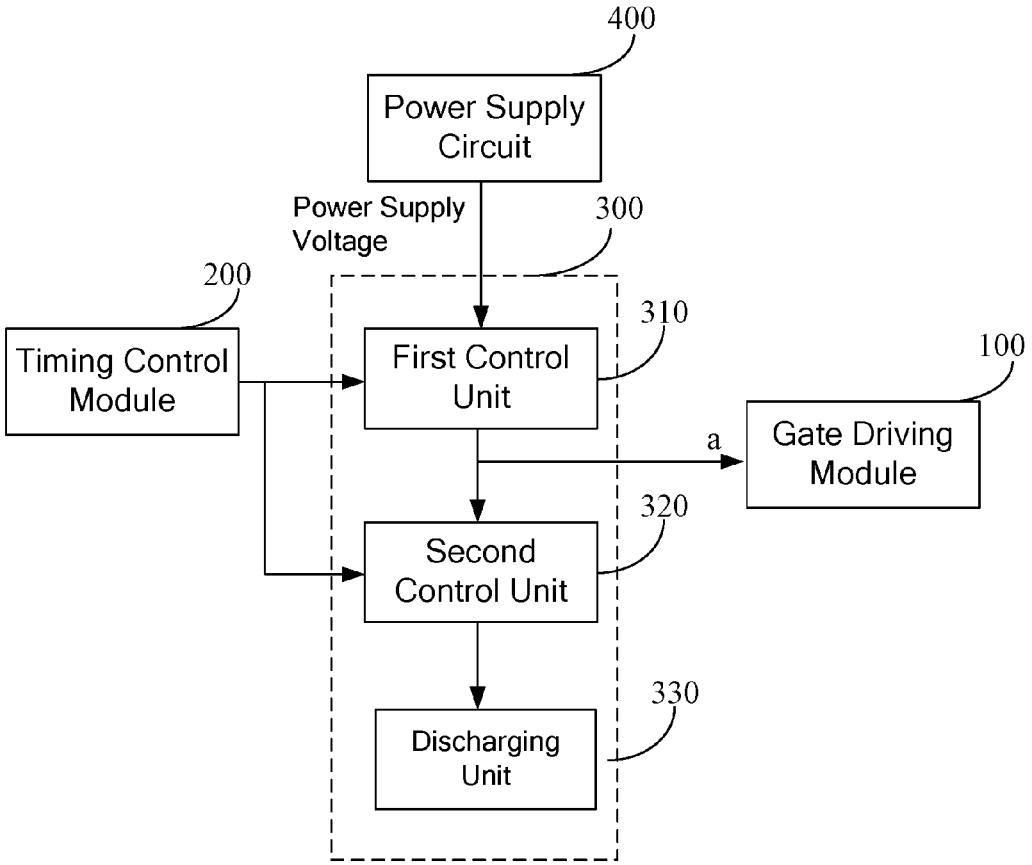
FIG. 2 is a schematic diagram of a structure of another driving circuit provided by an embodiment of the disclosure.

Further, as shown in FIG. 2, the chamfered wave generating circuit 300 can comprises a first control unit 310, a second control unit 320 and a discharging unit 330 connected in turn. A connection point of the first control unit 310 and the second control unit 320 is the output terminal (a) of the chamfered wave generating circuit.

In a case where the timing control signal output by the timing control module 200 is a first level signal, the second control unit 320 turns off under an effect of the timing control signal, and the first control unit 310 turns on under an effect of the timing control signal and outputs the power supply voltage provided by the power supply circuit 400 via the output terminal (a) of the chamfered wave generating circuit 300.

In a case where the timing control signal is a second level signal, the first control unit 310 turns off under an effect of the timing control signal, and the second control unit 320 turns on under an effect of the timing control signal and discharges the output terminal (a) of the chamfered wave generating circuit 300 via the discharging unit 330 so that the power supply voltage decreases to a predetermined value, and thus obtains a target chamfered wave signal, and then output the target chamfered wave signal to the gate driving module 100 via the output terminal (a) of the chamfered wave generating circuit 300.

Figure 3:
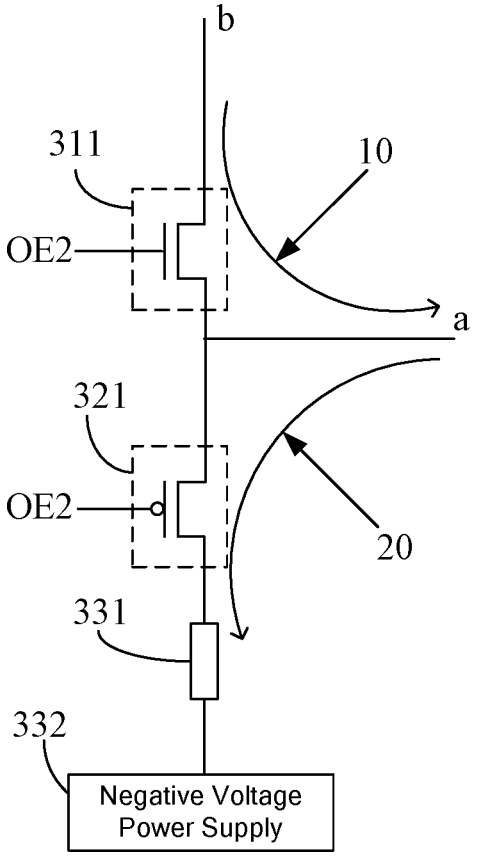
FIG. 3 is a schematic diagram of a structure of yet another driving circuit provided by an embodiment of the disclosure.

Referring to FIG. 2, optionally, as shown in FIG. 3, the first control unit can comprise a first transistor 311.

A first pole of the first transistor 311 can be connected with the output terminal of the timing control module, the second pole of the first transistor 311 can be connected with an output terminal of the power supply circuit, and the third pole of the first transistor 311 can be connected with the second control unit.

Optionally, as shown in FIG. 3, the second control unit can comprise a second transistor 321.

A first pole of the second transistor 321 can be connected with the output of the timing control module, a second pole of the second transistor 321 can be connected with the third pole of the first transistor 311, and the third pole of the second transistor 321 can be connected with the discharging unit. OE2 is a timing control signal output by the timing control module.

Optionally, as shown in FIG. 3, the discharging unit can comprise a discharging resistor 331 and a negative power supply 332.

On end of the discharging resistor 331 can be connected with the third pole of the second transistor 321, and the other end of the discharging resistor 331 can be connected with the negative power supply 332.

Optionally, the first transistor 311 can be an N-type transistor, the second transistor 321 can be a P-type transistor, the first level signal can be a high level signal and the second level signal can be a low level signal. As shown in FIG. 3, a MOS (Metal Oxide Semiconductor) switching device (i.e. the first transistor and the second transistor) acts as a time dividing switch under an effect of the timing control signal output by the timing control module. That is, only one transistor turns on at the same time. In a case where the time control signal output by the timing control module is a high level signal, the first transistor 311 turns on, the second transistor 321 turns off, a first channel 10 opens, the potential at the output terminal (a) is equal to that at (b), and the power supply voltage is output to the gate driving module via the output terminal (a) of the chamfered wave generating circuit. In a case where the timing control signal output by the timing control module is a low level signal, the first transistor 311 turns off, the second transistor 321 turns on, a second channel 20 opens, and the output terminal (a) of the chamfered wave generating circuit 300 discharges to the negative power supply 332 via the discharging resistor 331 so that the power supply voltage decreases to a predetermined value, and thus a target chamfered wave signal is obtained. For example, the voltage of the negative power supply 332 can be −8V~−5V. Therefore, a discharging current during the process of discharging is large, and the charges accumulated by a gate line can be released in time to form a periodical target chamfered wave signal with a big sawtooth depth, so that the gate driving module receives the target chamfered wave signal and outputs a chamfered wave scanning signal. In addition, the magnitude of the discharging current can be set by adjusting the resistance value of the discharging resistor, so that the potential at the gate can be prevented from falling largely when the level of the target chamfered wave signal changes, the feed through can be weakened, and the luminance of the displayed pictures and in turn the displaying quality of the display apparatus can be improved.

It should be noted that, in the field of TFT-LCD panel display, at the moment when TFT turns off, the potential at the gate lowers from a potential of a TFT turning on level VGH (Driver Output High) to a potential of a TFT turning off level VGL (Driver Output Low). The potential at the gate suffers a great fall which can reach 30V. Due to a parasitic capacitance between the gate and the source of the TFT, a potential at the source would also decrease. The fall of the potential at the source is denoted as ΔVp. Such a phenomenon is referred as feed through. A feed through will cause the data line writing voltage unequal to the storage capacitor voltage, the difference between the two being a fall ΔVp, causing the luminance of the final displayed pictures the display apparatus is low, and the displaying quality of the display apparatus is poor. In order to solve the feed through, a chamfered wave generating circuit can be used to convert a VGH signal, which should have been a DC power supply, into a periodical signal with small sawtooth, wherein the period of the occurrence of a slope corresponding the small sawtooth are the same with a row period of LCD scanning. Such a chamfered wave generating circuit outputs the periodical signal with small sawtooth to the gate driving module, and the gate driving module output the periodical signal with small sawtooth to a gate of corresponding TFT via multiple scanning lines.

Figure 4:
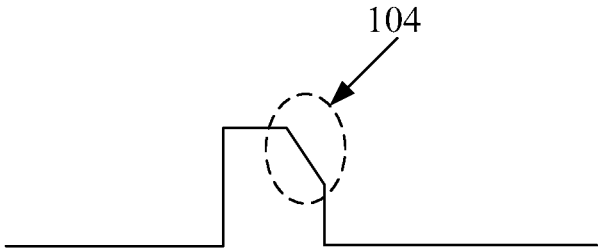
FIG. 4 is a schematic diagram of a local waveform of a periodical signal with small sawtooth.

FIG. 4 shows a schematic diagram of a local waveform of a periodical signal with small sawtooth. In FIG. 4, the chamfered wave 104 decreases the fall of the potential at the gate at the moment of turning off of the TFT, and in turn decreases the fall ΔVp of the potential at the source, through which the feed through is solved.

Figure 5:
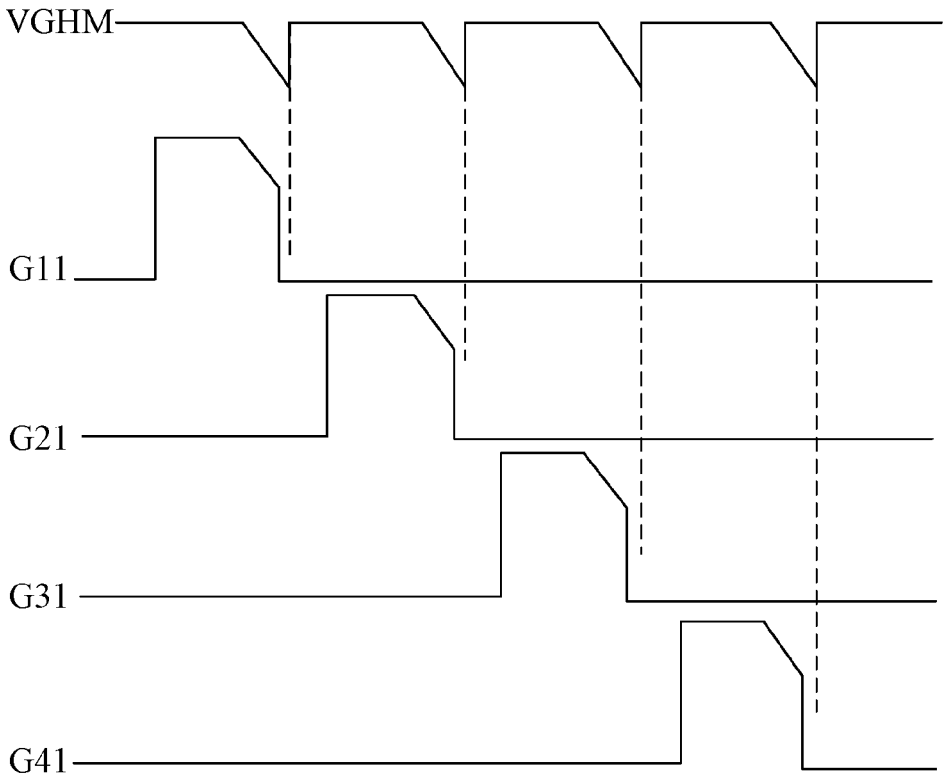
FIG. 5 are a schematic diagram of a waveform of a periodical signal with small sawtooth which is output by the chamfered wave generating circuit and a schematic diagram of a waveform of a periodical signal with small sawtooth which is on any adjacent four scanning lines.

FIG. 5 shows a schematic diagram of a periodical signal with small sawtooth which is output by the chamfered wave generating circuit and a schematic diagram of a waveform of a periodical signal with small sawtooth which is on any adjacent four scanning lines (i.e. G11, G21, G31 and G41).

For a display screen of a large sized AMOLED (Active Matrix/Organic Light Emitting Diode) panel, the large sized AMOLED display screen usually uses bottom Gate type Oxide TFT. Due to a large parasitic capacitance of such type of TFT, there is a serious feed through for the large sized AMOLED display screen. In order to solve the feed through in the large sized AMOLED display screen, if corresponding chamfered wave generating circuit shown in FIG. 4 is directly used, the fall of the potential of the periodical signal with small sawtooth will be small due to an too big load of the resistor-capacitance circuit of the large sized AMOLED display screen. The slope of the chamfered wave 104 in FIG. 4 is short, and the sawtooth depth of the small sawtooth periodical signal is too small, and therefore the effect of weakening the feed through is poor.

Figure 6:
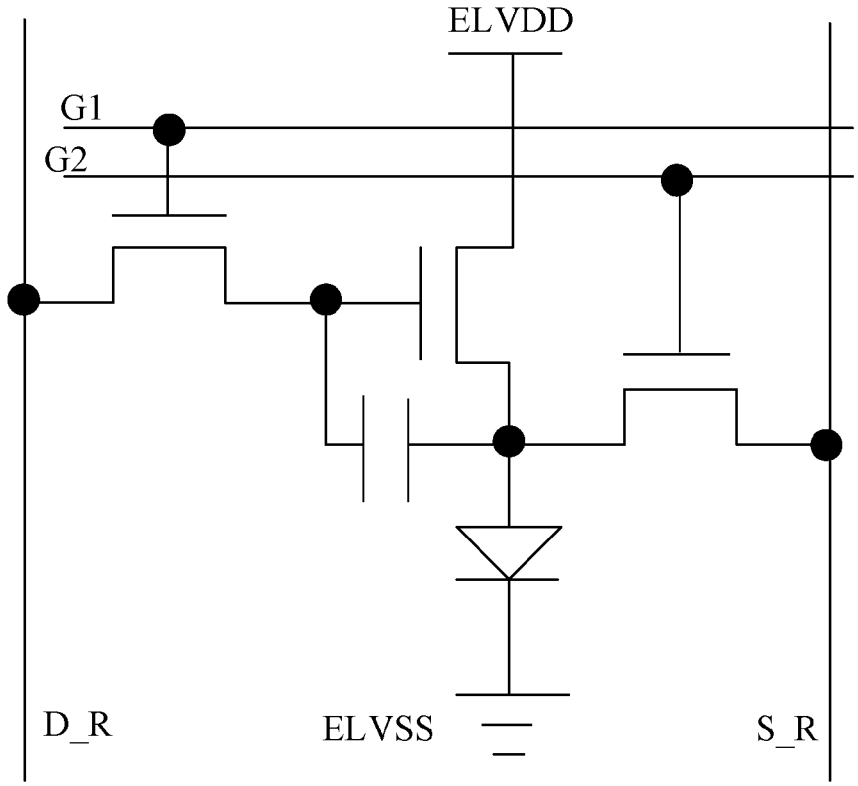
FIG. 6 is a schematic diagram of a structure of an external compensating pixel circuit.

Further, the large sized AMOLED display screen also comprises an external compensating pixel circuit, as shown in FIG. 6. The external compensating pixel circuit is configured to improve the uniformity of the luminance of the displayed pictures. However, since there is serious feed through for those large sized AMOLED display screen, at the moment of turning off of a TFT, the voltage of the storage capacitor falls a lot, that is, the voltage at the gate of the driving TFT will fall a lot, resulting that the driving TFT cannot open normally, and a sense line through which the pixel current flows cannot be charged, leading to a failed compensation, and finally, the improving of the uniformity of the luminance of the displayed pictures is poor.

In FIG. 6, ELVDD is the power supply for AMOLED display screen emitting lights, ELVSS is circumfluence current of ELVDD, G1 is a gate driving signal for opening a data line D_R, the data being written when the data line D_R is opened, and G2 is a signal of a detected pixel current flowing through the sense line S_R.

The driving circuit provided by the embodiments of the disclosure enlarges the discharging current, improves the slope of discharging, and generates a periodical target chamfered wave signal with bigger sawtooth depth, by which the potential at the gate can be prevented from falling a lot when the potential of the target chamfered wave signal changes, and the feed through can be weakened more efficiently, and the luminance of the displayed pictures and in turn the displaying quality of the display apparatus are improved. Meanwhile, for the large sized AMOLED display screen, since the feed through has been efficiently weakened, at the moment of turning off of a TFT, the change of voltage of the storage capacitor decreases, by which a sense line can be charged and the uniformity of the luminance of the displayed pictures can be improved.

As described above, the chamfered wave generating circuit of the driving circuit provided by the embodiments of the disclosure can discharge the power supply voltage provided by the power supply circuit of the display apparatus under an effect of the timing control signal output by the timing control module, can generate a periodical target chamfered wave signal with big sawtooth and output the target chamfered wave signal to the gate driving module, so that the gate driving module can output a chamfered wave scanning signal. Thus, the potential at the gate can be prevented from falling greatly when the level of the target chamfered wave signal changes, and the feed through can be weakened, and the luminance of the displayed pictures and in turn the quality of the display apparatus can be improved. Meanwhile, the changes of voltage of the storage capacitor of the large sized AMOLED display screen are decreased so that the sense line can be charged and the uniformity of the luminance of the displayed pictures is improved.

Figure 7:
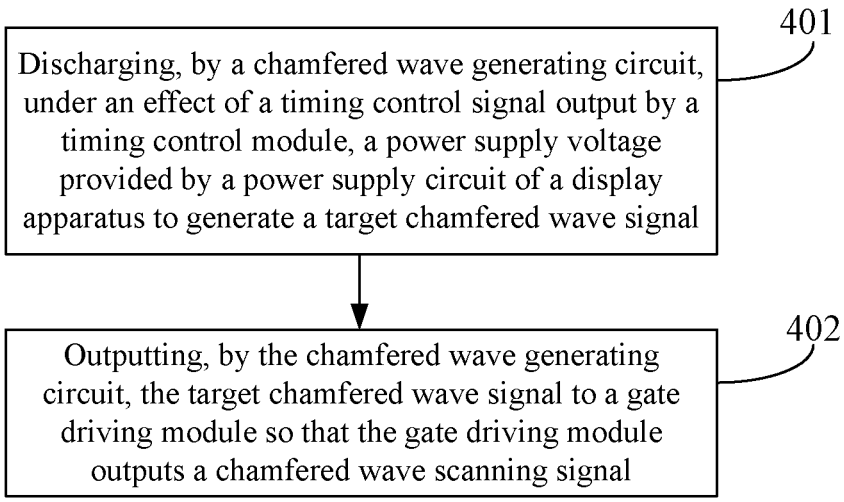
FIG. 7 is a flow chart of a driving method provided by an embodiment of the disclosure.

An embodiment of the present disclosure provides a driving method. As shown in FIG. 7, the method comprises:

in step 401, discharging, by a chamfered wave generating circuit, under an effect of a timing control signal output by a timing control module, a power supply voltage provided by a power supply circuit of a display apparatus to generate a target chamfered wave signal; and in step 402, outputting, by the chamfered wave generating circuit, the target chamfered wave signal to a gate driving module so that the gate driving module outputs a chamfered wave scanning signal.

As described above, through the driving method provided by the embodiments of the disclosure, the power supply voltage provided by the power supply circuit of the display apparatus can be discharged by the chamfered wave generating circuit under an effect of the timing control signal output by the timing control module, so as to generate a periodical target chamfered wave signal with big sawtooth depth, and then the target chamfered wave signal is output by the chamfered wave generating circuit to the gate driving module, so that the gate driving module outputs a chamfered wave scanning signal. Thus, the potential at the gate can be prevented from falling greatly when the level of the target chamfered wave signal changes, and the feed through is weakened, the luminance of the displayed pictures and in turn the quality of the display apparatus are improved.

Further, the chamfered wave generating circuit can comprises a first control unit, a second control unit and a discharging unit connected in turn, wherein a connection point between the first and second control units are an output terminal of the chamfered wave generating circuit.

Figure 8:
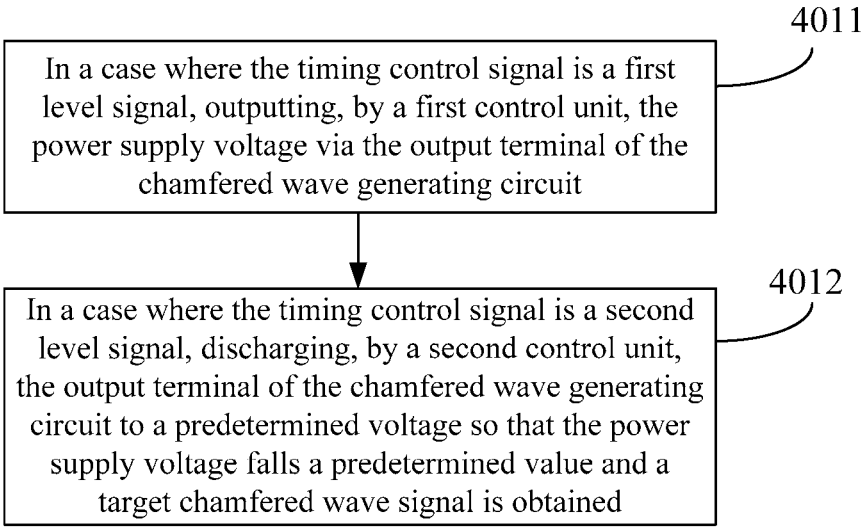
FIG. 8 is a flow chart of outputting a target chamfered wave signal to a gate driving module by a chamfered wave generating circuit.

Correspondingly, as shown in FIG. 8, the step 401 can comprises:

in step 4011, in a case where the timing control signal is a first level signal, outputting, by a first control unit, the power supply voltage via the output terminal of the chamfered wave generating circuit, wherein, as shown in FIG. 2, in a case where the timing control signal output by the timing control module 200 is the first level signal, the power supply voltage provided by the power source circuit 400 is output by the first control unit 310 via the output terminal (a) of the chamfered wave generating circuit 300;

in step 4012, in a case where the timing control signal is a second level signal, discharging, by a second control unit, the output terminal of the chamfered wave generating circuit to a predetermined voltage so that the power supply voltage falls a predetermined value and a target chamfered wave signal is obtained, wherein, as shown in FIG. 2, in a case where the timing control signal output by the timing control module 200 is the second level signal, the output terminal (a) of the chamfered wave generating circuit 300 is discharged by the second control unit 320 to a predetermined voltage via the discharging unit 330, so that the power supply voltage falls a predetermined value and a target chamfered wave signal is obtained.

Further, the step 402 can comprises outputting, via the output terminal of the chamfered wave generating circuit, the target chamfered wave signal to the gate driving module.

As shown in FIG. 2, the target chamfered wave signal can be output to the gate driving module 100 via the output terminal (a) of the chamfered wave generating circuit 300.

Optionally, as shown in FIG. 3, the first control unit can comprise a first transistor 311.

A first pole of the first transistor 311 can be connected with the output terminal of the timing control module, the second pole of the first transistor 311 can be connected with an output terminal of the power supply circuit, and the third pole of the first transistor 311 can be connected with the second control unit.

Optionally, as shown in FIG. 3, the second control unit can comprise a second transistor 321.

A first pole of the second transistor 321 can be connected with the output of the timing control module, a second pole of the second transistor 321 can be connected with the third pole of the first transistor 311, and the third pole of the second transistor 321 can be connected with the discharging unit.

Optionally, as shown in FIG. 3, the discharging unit can comprise a discharging resistor 331 and a negative power supply 332.

On end of the discharging resistor 331 can be connected with the third pole of the second transistor 321, and the other end of the discharging resistor 331 can be connected with the negative power supply 332.

Optionally, as shown in FIG. 3, the first transistor 311 can be an N-type transistor, the second transistor 321 can be a P-type transistor, the first level signal can be a high level signal and the second level signal can be a low level signal.

The first transistor and the second transistor implement a time dividing switch under an effect of the timing control signal output by the timing control module. That is, only one transistor turns on at the same time. In a case where the time control signal output by the timing control module is a high level signal, the first transistor 311 turns on, the second transistor 321 turns off, a first channel 10 opens, the potential at the output terminal (a) is equal to that at (b), and the power supply voltage is output to the gate driving module via the output terminal (a) of the chamfered wave generating circuit. In a case where the timing control signal output by the timing control module is a low level signal, the first transistor 311 turns off, the second transistor 321 turns on, a second channel 20 opens, and the output terminal (a) of the chamfered wave generating circuit 300 discharges to the negative power supply 332 via the discharging resistor 331 so that the power supply voltage decreases to a predetermined value, and thus a target chamfered wave signal is obtained. For example, the voltage of the negative power supply 332 can be −8V~−5V. Therefore, a discharging current during the process of discharging is large, and the charges accumulated by a gate line can be released in time to form a periodical target chamfered wave signal with a big sawtooth depth, so that the gate driving module receives the target chamfered wave signal and outputs a chamfered wave scanning signal. In addition, the magnitude of the discharging current can be set by adjusting the resistance value of the discharging resistor, so that the potential at the gate can be prevented from falling largely when the level of the target chamfered wave signal changes, the feed through can be weakened, and the luminance of the displayed pictures and in turn the displaying quality of the display apparatus can be improved.

As described above, through the driving method provided by the embodiments of the disclosure, the power supply voltage provided by the power supply circuit of the display apparatus can be discharged by the chamfered wave generating circuit under an effect of the timing control signal output by the timing control module, so as to generate a periodical target chamfered wave signal with big sawtooth depth, and then the target chamfered wave signal is output by the chamfered wave generating circuit to the gate driving module, so that the gate driving module outputs a chamfered wave scanning signal. Thus, the potential at the gate can be prevented from falling greatly when the level of the target chamfered wave signal changes, and the feed through is weakened, the luminance of the displayed pictures and in turn the quality of the display apparatus are improved. Meanwhile, the changes of voltage of the storage capacitor of the large sized AMOLED display screen are decreased so that the sense line can be charged and the uniformity of the luminance of the displayed pictures is improved.

An embodiment of the present disclosure further provides a display apparatus comprising the driving circuit shown as in FIG. 1, 2 or 3.

The above is only some embodiments of the present disclosure, instead of limiting the present disclosure. Any modification, replacement and improvement made within the spirit and principle of the disclosure falls in the scope of the present disclosure.

The present application claims priority of the Chinese Patent Application No. 201610051667.3 filed on Jan. 26, 2016, the entire disclosure of which is hereby incorporated in full text by reference as part of the present application.

What is claimed is:

1. A driving circuit for an Active Matrix/Organic Light Emitting Diode (AMOLED) display, comprising:

a gate driving module;

a timing control module; and a chamfered wave generating circuit, wherein the chamfered wave generating circuit comprises a first control unit, a second control unit, and a discharging unit connected in turn, and a connection point of the first and second control units being an output terminal of the chamfered wave generating circuit, and wherein the first control unit comprises a first transistor, a first pole thereof being connected with an output terminal of the timing control module, a second pole thereof being connected with an output terminal of a power supply circuit of an AMOLED display apparatus, and a third pole thereof being connected with the second control unit, wherein the second control unit comprises a second transistor, a first pole thereof being connected with the output terminal of the timing control module, a second pole thereof being connected with the third pole of the first transistor, and a third pole thereof being connected with the discharging unit, and wherein the discharging unit comprises a discharging resistor and a negative power supply having a predetermined negative voltage, one end of the discharging resistor being connected with the third pole of the second transistor, and the other end of the discharging resistor being connected with the negative power supply, wherein an input terminal of the chamfered wave generating circuit is connected with the input terminal of the timing control module, and an output terminal of the chamfered wave generating circuit is connected with an input terminal of the gate driving module, wherein the chamfered wave generating circuit is configured to discharge a power supply voltage provided by the power supply circuit of the AMOLED display apparatus to the predetermined negative voltage via the discharging resistor to generate a discharge current with a predetermined current value under an effect of a timing control signal output by the timing control module, to generate a target chamfered wave signal with a predetermined sawtooth depth and to output the target chamfered wave signal to the gate driving module, so that the gate driving module outputs a chamfered wave scanning signal, wherein the predetermined negative voltage ranges from −8V~−5V.

2. The driving circuit of claim 1, wherein in a case where the timing control signal is a first level signal, the second control unit turns off under the effect of the timing control signal, and the first control unit turns on under the effect of the timing control signal and outputs the power supply voltage via the output terminal of the chamfered wave generating circuit; and in a case where the timing control signal is a second level signal, the first control unit turns off under the effect of the timing control signal, and the second control unit turns on under the effect of the timing control signal and discharges the output terminal of the chamfered wave generating circuit via the discharging unit so that the power supply voltage decreases a predetermined value and the target chamfered wave signal is obtained, and then outputs the target chamfered wave signal to the gate driving module via the output terminal of the chamfered wave generating circuit.

3. The driving circuit of claim 2, wherein the first transistor is an N-type transistor, the second transistor is a P-type transistor, the first level signal is a high level signal and the second level signal is a low level signal.

4. The driving circuit of claim 2, wherein the first transistor is an N-type transistor, the second transistor is a P-type transistor.

5. A display apparatus, comprising the driving circuit of claim 1.

6. The display apparatus of claim 5, wherein in a case where the timing control signal is a first level signal, the second control unit turns off under the effect of the timing control signal, and the first control unit turns on under the effect of the timing control signal and outputs the power supply voltage via the output terminal of the chamfered wave generating circuit; and in a case where the timing control signal is a second level signal, the first control unit turns off under the effect of the timing control signal, and the second control unit turns on under the effect of the timing control signal and discharges the output terminal of the chamfered wave generating circuit via the discharging unit so that the power supply voltage decreases a predetermined value and the target chamfered wave signal is obtained, and then outputs the target chamfered wave signal to the gate driving module via the output terminal of the chamfered wave generating circuit.

7. A driving method for an Active Matrix/Organic Light Emitting Diode (AMOLED) display, comprising:

discharging, by a chamfered wave generating circuit, under an effect of a timing control signal output by a timing control module, a power supply voltage provided by a power supply circuit of an AMOLED display apparatus to a predetermined negative voltage via a discharging resistor to generate a discharge current with a predetermined current value, to generate a target chamfered wave signal with a predetermined sawtooth depth, wherein the predetermined negative voltage ranges from −8V~−5V; and outputting, by the chamfered wave generating circuit, the target chamfered wave signal to a gate driving module so that the gate driving module outputs a chamfered wave scanning signal, wherein the chamfered wave generating circuit comprises a first control unit, a second control unit, and a discharging unit connected in turn, and a connection point of the first and second control units being an output terminal of the chamfered wave generating circuit, and wherein the first control unit comprises a first transistor, a first pole thereof being connected with an output terminal of the timing control module, a second pole thereof being connected with an output terminal of the power supply circuit of the AMOLED display apparatus, and a third pole thereof being connected with the second control unit, wherein the second control unit comprises a second transistor, a first pole thereof being connected with the output terminal of the timing control module, a second pole thereof being connected with the third pole of the first transistor, and a third pole thereof being connected with the discharging unit, and wherein the discharging unit comprises the discharging resistor and a negative power supply having the predetermined negative voltage, one end of the discharging resistor being connected with the third pole of the second transistor, and the other end of the discharging resistor being connected with the negative power supply.

8. The driving method of claim 7, wherein in a case where the timing control signal is a first level signal, the power supply voltage is output by the first control unit via the output terminal of the chamfered wave generating circuit; and in a case where the timing control signal is a second level signal, the output terminal of the chamfered wave generating circuit is discharged to a predetermined voltage by the second control unit via the discharging unit, so that the power supply voltage decreases a predetermined value, and the target chamfered wave signal is obtained.

9. The driving method of claim 8, wherein the target chamfered wave signal is output to the gate driving module via the output terminal of the chamfered wave generating circuit.

10. The driving method of claim 8, wherein the first transistor is an N-type transistor, the second transistor is a P-type transistor, the first level signal is a high level signal and the second level signal is a low level signal.

11. The driving method of claim 8, wherein the first transistor is an N-type transistor, the second transistor is a P-type transistor.

* * * * *